US011602674B2

(12) United States Patent
Moon et al.

(10) Patent No.: US 11,602,674 B2
(45) Date of Patent: Mar. 14, 2023

(54) GOLF BALL HAVING A SPHERICAL SURFACE IN WHICH A PLURALITY OF COMBINATION DIMPLES ARE FORMED

(71) Applicant: VOLVIK INC., Chungcheongbuk-do (KR)

(72) Inventors: Kyung Ahn Moon, Seoul (KR); In Hong Hwang, Gyeonggi-do (KR)

(73) Assignee: VOLVIK INC., Chungcheongbuk-do (KR)

( * ) Notice: Subject to any disclaimer, the term of this patent is extended or adjusted under 35 U.S.C. 154(b) by 0 days.

(21) Appl. No.: 17/361,935

(22) Filed: Jun. 29, 2021

(65) Prior Publication Data

US 2021/0402261 A1 Dec. 30, 2021

(30) Foreign Application Priority Data

Jun. 30, 2020 (KR) ..... 10-2020-0080505

(51) Int. Cl.
*A63B 37/14* (2006.01)
*A63B 37/00* (2006.01)

(52) U.S. Cl.
CPC ..... *A63B 37/0009* (2013.01); *A63B 37/002* (2013.01); *A63B 37/0019* (2013.01); *A63B 37/00065* (2020.08)

(58) Field of Classification Search
CPC ..... A63B 37/0009; A63B 37/0007–0011
USPC ..... 473/384; D21/708–709
See application file for complete search history.

(56) References Cited

U.S. PATENT DOCUMENTS 2,106,704 A * 2/1938 Davis ..... A63B 37/0009 D21/708
D176,470 S * 12/1955 Martin et al. ..... D21/708
2,861,810 A * 11/1958 Veatch ..... A63B 24/0021 D21/709

(Continued)

FOREIGN PATENT DOCUMENTS

JP 1993-084328 A 4/1993
JP 4129625 B2 8/2003

(Continued)

OTHER PUBLICATIONS

Office action containing cited art for Korean Application No. 10-2020-0080505 dated Jan. 28, 2021, 2 pages.

*Primary Examiner* — Eugene L Kim
*Assistant Examiner* — Matthew B Stanczak
(74) *Attorney, Agent, or Firm* — Kilpatrick Townsend & Stockton LLP

(57) ABSTRACT

The present disclosure relates to a golf ball, wherein dimples having an extraordinary flight performance by combining the advantages of both circular dimples and polygonal dimples in the related art, in other words, by arranging the combined dimples that give depth to the face of the combined polygon and circle of the same center on the surface of the sphere, the trajectory is bent due to the influence of wind, which is a disadvantage of the conventional polygonal dimples. It is excellent in flight straightness by eliminating the effect, and when flying after hitting, the vertex region, which acts as a small bluff body, rotates and breaks the pressure in advance, causing a quick turbulent transition, and it becomes like an arc of a circular dimple instead of the sides of the general polygonal dimples.

15 Claims, 7 Drawing Sheets

(56) References Cited

U.S. PATENT DOCUMENTS 4,090,716 A * 5/1978 Martin ..... A63B 37/0019 473/379
4,869,512 A * 9/1989 Nomura ..... A63B 37/0009 473/383
5,143,377 A * 9/1992 Oka ..... A63B 37/0096 473/383
5,174,578 A * 12/1992 Oka ..... A63B 37/0026 473/383
5,338,039 A * 8/1994 Oka ..... A63B 37/0009 473/384
5,377,989 A * 1/1995 Machin ..... A63B 37/0021 473/379
5,536,013 A 7/1996 Pocklington
5,720,676 A * 2/1998 Shimosaka ..... B23P 15/24 473/384
6,254,496 B1 * 7/2001 Maehara ..... A63B 37/0008 473/378
6,290,615 B1 9/2001 Ogg
6,315,686 B1 11/2001 Barfield
6,390,740 B1 * 5/2002 Nesbitt ..... A63B 37/0007 409/86
7,686,709 B2 3/2010 Aoyama
8,591,355 B2 * 11/2013 Sullivan ..... A63B 37/0012 473/383
9,782,629 B2 * 10/2017 Nardacci ..... A63B 37/0008
10,195,485 B2 * 2/2019 Nardacci ..... A63B 37/0007
10,300,340 B2 * 5/2019 Madson ..... A63B 37/00065
10,420,986 B2 * 9/2019 Madson ..... A63B 37/00065
10,532,250 B2 * 1/2020 Madson ..... A63B 37/002
2002/0032083 A1 * 3/2002 Ogg ..... A63B 37/0005 473/378
2002/0165044 A1 * 11/2002 Sullivan ..... A63B 37/0006 473/378
2003/0045379 A1 * 3/2003 Sajima ..... A63B 37/0018 473/378
2003/0158002 A1 * 8/2003 Morgan ..... A63B 37/0012 473/383
2004/0082409 A1 * 4/2004 Kasashima ..... A63B 37/0019 473/383
2005/0014579 A1 * 1/2005 Asakura ..... A63B 37/0004 473/378
2005/0090335 A1 * 4/2005 Kennedy, III ..... A63B 37/0021 473/383
2005/0187039 A1 * 8/2005 Kennedy, III ..... A63B 37/0076 473/378
2005/0266934 A1 * 12/2005 Morgan ..... A63B 37/0009 473/383
2006/0068940 A1 * 3/2006 Sato ..... A63B 37/0018 473/378
2006/0089211 A1 * 4/2006 Sato ..... A63B 37/0004 473/378
2006/0142098 A1 * 6/2006 Sajima ..... A63B 37/0012 473/378
2007/0015609 A1 * 1/2007 Kasashima ..... A63B 37/0009 473/383
2012/0302377 A1 * 11/2012 Sato ..... A63B 37/0008 473/383
2013/0267349 A1 * 10/2013 Umemura ..... A63B 37/0007 473/379
2015/0306461 A1 * 10/2015 Parsons ..... A63B 37/0009 473/384
2016/0107037 A1 * 4/2016 Parsons ..... A63B 37/0009 473/383
2017/0136302 A1 * 5/2017 Nardacci ..... A63B 37/0007
2017/0136303 A1 * 5/2017 Nardacci ..... A63B 37/0008
2017/0136304 A1 * 5/2017 Nardacci ..... A63B 37/0007
2017/0136307 A1 * 5/2017 Nardacci ..... A63B 37/0004
2017/0189760 A1 * 7/2017 Madson ..... A63B 37/0007
2017/0319908 A1 * 11/2017 Madson ..... A63B 37/002
2018/0036596 A1 * 2/2018 Madson ..... A63B 37/002
2018/0036598 A1 * 2/2018 Nardacci ..... A63B 37/0009
2018/0036600 A1 * 2/2018 Madson ..... A63B 37/0008
2018/0272193 A1 * 9/2018 Madson ..... A63B 37/002
2018/0339201 A1 * 11/2018 Sato ..... A63B 37/0018
2020/0108297 A1 * 4/2020 Madson ..... A63B 37/0011
2020/0139196 A1 * 5/2020 Madson ..... A63B 37/002
2020/0171357 A1 * 6/2020 Madson ..... A63B 37/0004
2020/0276480 A1 * 9/2020 Madson ..... A63B 37/0019

FOREIGN PATENT DOCUMENTS

JP 2008-012299 A 1/2008
JP 2008-073552 A 4/2008

* cited by examiner

GOLF BALL HAVING A SPHERICAL SURFACE IN WHICH A PLURALITY OF COMBINATION DIMPLES ARE FORMED

CROSS-REFERENCE TO RELATED APPLICATION

This application is based on and claims priority under 35 U.S.C. § 119 to Korean Patent Application No. 10-2020-0080505, filed on Jun. 30, 2020, in the Korean Intellectual Property Office, the disclosure of which is incorporated by reference herein in its entirety.

BACKGROUND

1. Field

The present disclosure relates to a golf ball, the golf ball having a reduced resistance during flight and an increased flying distance by forming a new type of dimple different from dimple shapes that are commonly used.

2. Description of Related Art

In a golf ball, dimples have very important aerodynamic functions. Circular dimples or polygonal dimples symmetrically arranged are formed on surfaces of general golf balls. When the golf ball is struck by a golf club head, a rebound resilience of the golf ball is induced and the golf ball bounces out at a high speed, and at the same time, a reverse rotation occurs due to a loft angle of the club head. In a golf ball flying in reverse rotation, air pressure accumulates in the lower part under the influence of dimples, and the pressure decreases rapidly in the upper part, thereby generating a lift that is several times the gravity, which gradually rises and increases the flying distance by increasing the flying time.

In this case, under the influence of the dimples, an air flow causes turbulence and moves a separation point of a boundary layer to a rear portion of the golf ball and then reduces a drag coefficient due to the rapid air flow, and therefore, resistance during flight is reduced and the flying distance increases.

A flight trajectory indicating a flying trace is as important as the flying distance. The flight trajectory is important as it indicates a flying distance to a flying peak after the shot is taken, a degree of straightness in which a flying direction inclines to the left or right or is straight in a proceeding direction, a landing point of the golf ball according to the degree of straightness, a falling angle and a falling distance to the ground after the peak, and the like. In addition, the flight performance to overcome wind influences such as headwind, tailwind, and crosswind is one of the important factors of dimples.

The flight performance that is aerodynamically important is determined according to shapes or sizes of the dimples, roughness indicating how rough the dimples are, a proportion of an area and a volume to an area and a depth of the dimple, and the like.

That is, although basic factors of the flight performance are determined according to differences in speed of the club head, and weight, size, hardness, and rebound resilience capacity of the golf ball, the flight performance of the golf ball is significantly influenced by the dimples that are already formed.

In the case of circular dimples that are most commonly used in golf balls, a golf ball including dimples with a large diameter and similar dimple depths easily gains a lift after the shot and obtains a trace of a high trajectory, wherein a drag coefficient in a high-speed region to the peak is large but the drag coefficient in a low-speed region after the peak rather decreases. However, due to being highly influenced by the wind, the flying distance increases in the tailwind, but the landing point is not constant in the headwind or crosswind, and therefore, there is a problem with directionality. On the contrary, in the case of a golf ball including dimples that have a small diameter, as it is difficult to obtain the lift after the shot, the golf ball has a trace of a low trajectory, and a drag coefficient decreases compared to that of a large-sized dimple in a high-speed region but increases in a low-speed region. However, unlike with large-sized dimples, the golf ball is less influenced by the wind and the directionality thereof does not deteriorate.

Comparing the case of simply varying the depth of the dimple in a golf ball of the same diameter, it becomes easier to obtain lift when the depth gets deeper, but in the high-speed region, the pressure drag increases rapidly, reducing the flying distance, and if the depth is too deep, the influence of the wind is greatly affected. On the contrary, if the depth becomes too shallow, the total dimple volume becomes small, so that sufficient lift cannot be obtained and the distance is reduced. In a golf ball including circular dimples, the dimples are arranged by dividing a surface of a sphere into a virtual spherical polyhedron in a symmetrical manner. However, even with an effort to minimize a portion without dimples, that is, a land portion, it is difficult to make an area ratio of the land portion, that is, a dimple area ratio, 82% to 83% or more with reference to a total surface area of the sphere. When a total dimple area of a golf ball having a dimple area ratio from 82% to 83% and an appropriate depth calculated according to a frustum depth is from 390 $mm^3$ to 420 $mm^3$, a result with an excellent flight performance is obtained.

In a golf ball including polygonal dimples, bottom surfaces at a dimple depth generally have a circular or oval shape, and under the influence of the shape of bottom surfaces, general flight performances are similar to those of circular dimples. However, the bottom surfaces with a deeper depth are highly influenced by wind and have poor straightness, and therefore, a landing point is not constant. However, the bottom surfaces with a shallow depth have a low trajectory and are less influenced by wind, being more stable than the bottom surfaces with a deeper depth, but the flying distance is decreased. The golf ball including the polygonal dimples caused a turbulent transition faster than that of the golf ball including the circular dimples, but the pressure drag also rapidly increased, and therefore, the flying distance is not increased.

Despite these shortcomings, the polygonal dimples may form a rapid turbulent transition, and according to arrangements of the dimples, the land portion having a direct influence on the flying distance may be minimized, and thus, great progress may be made.

U.S. Pat. No. 6,290,615 B1 describes a case in which a golf ball has polygonal dimples and a peripheral region around a peak of a protrusion region between the dimples, such that a drag is more reduced than in a case where general dimples are merely dug in a round shape in the sphere and a portion at which the dimples meet are angled.

U.S. Pat. No. 6,315,686 B1 describes a case in which spherical concave surfaces around the polygon are overlapped and the polygon has a ridge-like polygon shape and easily forms a turbulent boundary layer, and may achieve a high speed without interference even in a low-speed region.

U.S. Pat. No. 7,686,709 B2 describes a dimple in which lobes having ridges are connected like spokes around a center of a dimple and a connected portion between lobes becomes a concave portion.

In U.S. Pat. No. 5,143,377, in a case where dimples are arranged at about fifteen degrees around a large circle of a sphere as an L-spherical region and other portions as an F-spherical region, dimples having a regular polygon shape are arranged in 60% or more of the L-spherical region, and circular dimples are arranged in 60% or more of the F-spherical region.

U.S. Pat. No. 5,536,013 discloses a case in which a center portion of a cross-section of a dimple is concave and a portion surrounding the center portion is pushed down to a depth of a regular dimple, and a shape of the dimple is circular or polygonal.

PRIOR ART DOCUMENTS

Patent Documents

U.S. Pat. No. 6,290,615 B1
U.S. Pat. No. 6,315,686 B1
U.S. Pat. No. 7,686,709 B2
U.S. Pat. No. 5,143,377
U.S. Pat. No. 5,536,013

SUMMARY

To overcome the shortcomings in the related art, the present disclosure provides a golf ball having an extraordinary flight performance that may combine a high turbulence transition capacity of polygonal dimples with the flying tenacity and flying stability of circular dimples.

Additional aspects will be set forth in part in the description which follows and, in part, will be apparent from the description, or may be learned by practice of the presented embodiments of the disclosure.

The present disclosure relates to a golf ball, wherein, when a plurality of dimples are arranged on a surface of the golf ball, the dimples have a shape of a combination dimple in which a depth is given to a surface that is made by combination of a circle ci and a polygon po having a same center, and the combination dimples co are arranged on the entire surface of the golf ball, or 50% or more of the surface is arranged with the combination dimples co and the rest is arranged with general circular dimples. Although the polygons po and the circle ci included in the combination dimple co are concentric, a diameter d of the circle ci is greater than an inscribed circle di of the polygon po and smaller than a circumscribed circle dc of the polygon po. That is, in the relationship of $dc<d<di$, the circle ci included in the combination dimple co has one diameter but is combined with the polygon co, and therefore, in a face that is shown, according to polygon types, only arc faces of an identical number as that of edges of the polygon po are shown. Accordingly, when the polygon is a pentagon, five arcs having an equal radius are shown, and when the polygon is a hexagon, six arc faces having an equal radius are shown.

In the edges of the polygon po included in the combination dimple co, portions overlapping with the arc faces that are generated by dividing the circle ci are invisible, and only each vertex and a fragment portion of a portion of an edge connected thereto (hereinafter, referred to as a vertex region vr) are visible. Accordingly, when the polygon is a pentagon, five vertices yr having same shape and size are shown, and when the polygon is a hexagon, six vertices yr having same shape and size are shown. The vertex region vr, which is a small bluff body sb being important portion of the present disclosure, reduces a drag by dispersing in advance a pressure applied to the entire dimples of the golf ball, and the flying distance increases. Due to the arc faces being widen instead of being removed, the edges of the polygon po may reduce the problem of directionality shown in golf balls including general polygonal dimples.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 1 also shows a vertex region yr made of a peak of the polygon po and fragments of edges that are left after being cut by a surface of the circle, wherein the vertex region yr becomes a small bluff body sb, and a dimple depth hp when the polygon is made into a dimple and a dimple hc when the circle is made into a dimple, wherein the depth of the combination dimple co may be shown as two depths that are shown as one or each of the combination dimples co has its own depth.

DETAILED DESCRIPTION

Figure 1:
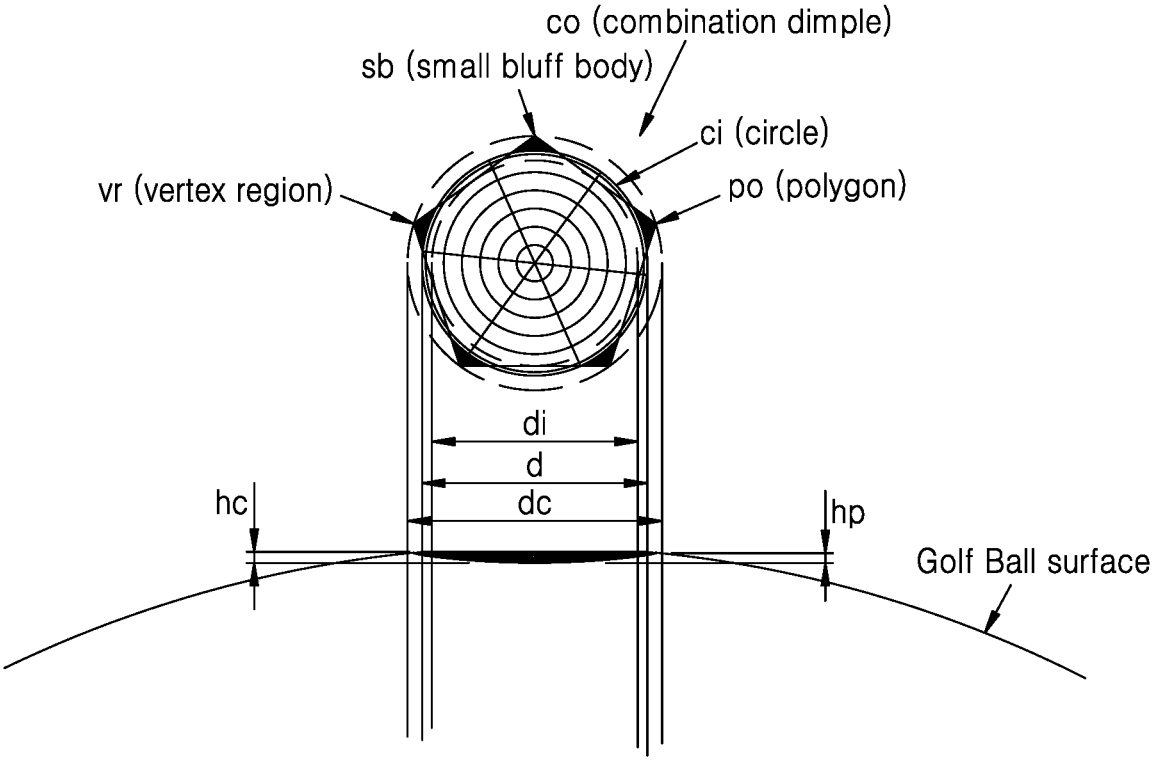
FIG. 1 shows a configuration of a combination dimple co, in which a depth is given to a face having a combined shape made by a circle having a diameter d and a polygon po having an inscribed circle having a diameter di and a circumscribed circle having a diameter dc, which are elements of the combination of the present disclosure.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

The present disclosure relates to a dimple having an extraordinary flight performance by combining advantages circular dimples and polygonal dimples in the related art, that is, a combination dimple having extraordinary flight straightness and being capable of increasing a flight distance by causing a rapid turbulent transition and decreasing a drag, wherein the combination dimples in which a depth is given to a surfaces having a combined shape of a polygon and a circle being concentric on a surface of a sphere, and bending of a trajectory under high influence by the wind, which is a shortcoming of the polygonal dimples in the related art, is eliminated.

A golf ball according to embodiments of the present disclosure will be described in detail with reference to the accompanying drawings.

Figure 2:
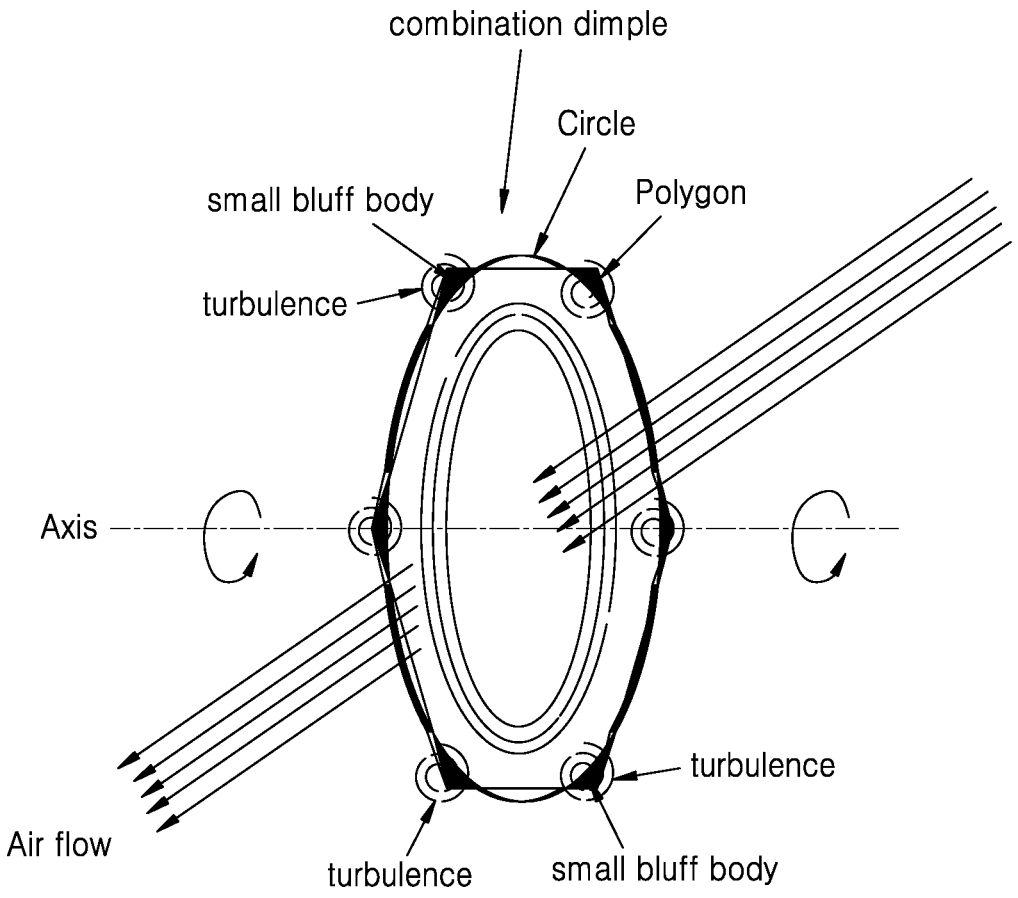
FIG. 2 shows a case in which the combination co flies while performing a reverse rotation, and more particularly, shows a case in which a small-unit turbulence is generated around the small bluff body sb shown in FIG. 1 and reduces, in advance, a pressure applied to the entire dimple, such that the turbulence transition in the combination dimple co is easily performed against a fast air flow.

FIG. 2 shows a case in which the golf ball including the combination dimple co flies while performing a reverse rotation, and more particularly, shows a case in which a small-unit turbulence is generated around the small bluff body sb shown in FIG. 1 and reduces, in advance, a pressure applied to the entire dimple, such that the turbulence transition in the combination dimple co is easily performed against a fast air flow.

As shown in FIG. 2, a size of the small bluff body sb which reduces the drag in a strong airflow is determined according to type of a polygon and a diameter of a circle that is suitable for the polygon.

Figure 3:
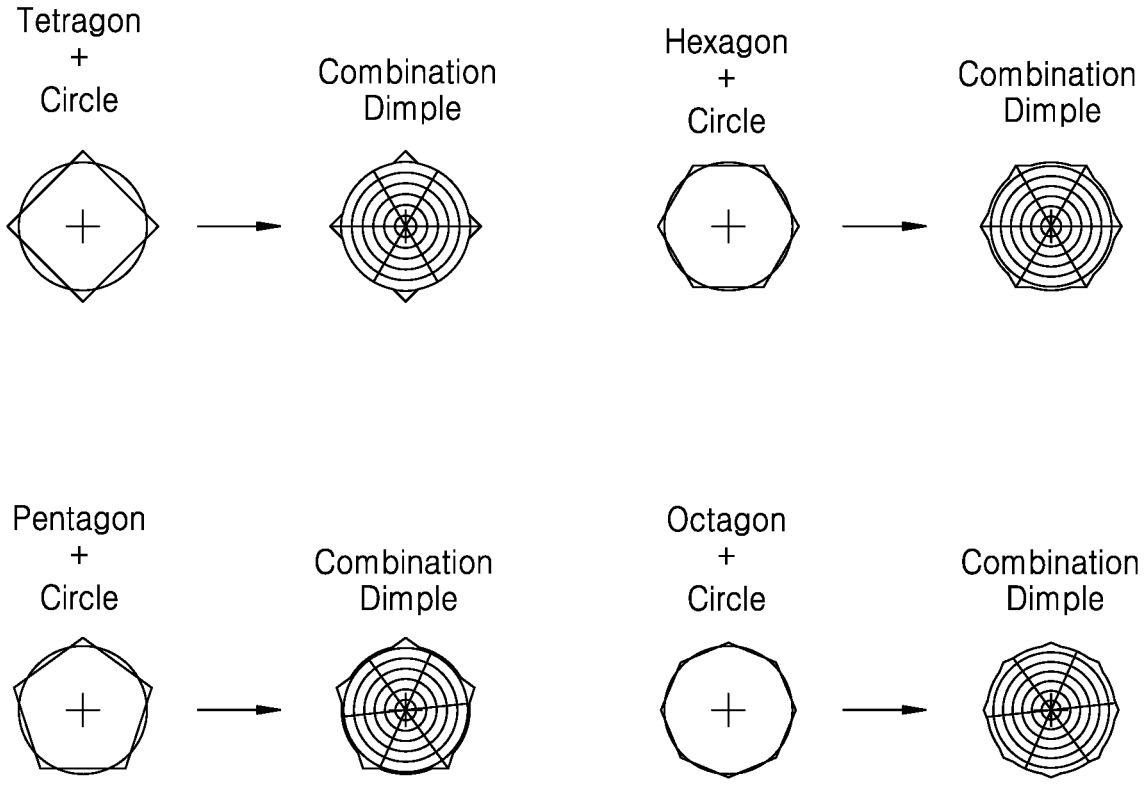
FIG. 3 shows actual shapes of combination dimples co in which a depth is given to a face having a combined shape made by various types of polygons and circles.

FIG. 3 shows actual shapes of combination dimples co in which a depth is given to a face having a combined shape made by various types of polygons and circles.

In the case of combination dimple co in which a depth is given to a face having a combined shape made by a square and a circle among the combination dimples shown in FIG. 3, an appropriate diameter d of a circle, which is included in a combination dimple between a diameter di of an inscribed circle of the square and a diameter dc of a circumscribed circle of the square, is from 82% to 88% of the diameter dc. Therefore, from 12% to 18% of a diameter of the circumscribed circle from the vertex of the square in a direction of a center of the circle is a size of the small bluff body sb.

In the case of a combination dimple co in which a depth is given to a face having a combined shape made by a pentagon and a circle among the combination dimples shown in FIG. 3, an appropriate diameter d of a circle, which is included in a combination dimple existing between a diameter di of an inscribed circle of the pentagon and a diameter dc of a circumscribed circle of the pentagon, is from 85% to 91% of the diameter dc. The size of small bluff body sb of the combination dimple of the pentagon and circle is from 9% to 15% of a radius of a circumscribed circle of the pentagon from a vertex of the pentagon in a direction of a center of the circle.

When a depth is given to a face having a combined shape made by a hexagon and a circle among the combination dimples co, an appropriate diameter d of the circle included in the combination dimple co is from 88% to 94% of the diameter dc of a circumscribed circle of the hexagon. Accordingly, the small bluff body sb in the combination dimple co in which the depth is given to the face having the combined shape of the hexagon and the circle is from 6% to 12% of a radius of the circumscribed circle of the hexagon.

Among the combination dimples in FIG. 3, when the combination dimple co is made by an octagon and a circle, a diameter d of an appropriate circle included in the combination dimple co is from 92% to 98% of the diameter dc of the circumscribed circle of the octagon. Accordingly, the small bluff body sb in the combination dimple co in which the depth is given to the face having the combined shape of the octagon and the circle is from 2% to 8% of a radius of the circumscribed circle of the octagon. As described above, an appropriate size of the circle ci included in the combination dimple is from 82% to 98% of a diameter dc of a circumscribing circle of the corresponding polygon po, and the size of small bluff body sb according thereto is determined between 2% and 18% of a radius of a circumscribed circle of the corresponding polygon from a vertex of the polygon in a direction of a center of the circle.

Like this, the size of the small bluff body sb gradually decreases as the number of vertices of the polygon increases. In other words, as the number of vertices of the polygon increases, a shape thereof becomes close to a circle, the size of the small bluff body sb decreases, and functions thereof also decrease. Accordingly, a combination dimple in which a depth is given to a face having a combined nonagon or more shape of polygon and a circle has a similar flight performance without difference as that of a general circular dimple.

FIG. 1 is a diagram showing an example of a dimple formed on a surface of the golf ball according to the present disclosure.

As shown in FIG. 1, a depth is given to a face having a combined shape of the polygon and the circle, and when the depth pushes the surface of the sphere into a certain shape and the surface is dug, the combination dimple co is formed. Regarding the depths, a depth of the polygon is a depth formed by giving a corresponding depth to a surface made by a circumscribed circle and pushed onto the surface of the sphere, a depth of the circle is a depth formed by giving a depth to a surface made by the circle and pushed onto the surface of the sphere, both are frustum depths formed by cutting the sphere in a planar manner, which indicate a difference between a deepest portion of the dimple and a top end of the dimple. Although the depths seems to be one depth, as it is required that the depth of the polygon is shown in a way that a protruded portion of the vertex region yr is pushed onto the sphere, and only when the depth hp is given to the surface made by the circumscribed circle of the polygon, the vertex region yr is clearly shown and functions as the small bluff body sb.

The depths hp and he may be an identical depth or different depths. A depth of a dimple varies according to a size of the dimple. However, when the depth is 0.25 mm or deeper, wind resistance increases and causes lack of flight stability, and when the depth decreases to 0.1 mm or more shallow, it is hard to obtain a lift and a flying distance decreases. Therefore, it is preferable that the depth of the combination dimple is from 0.1 mm to 0.25 mm based on the frustum depth.

Figure 4:
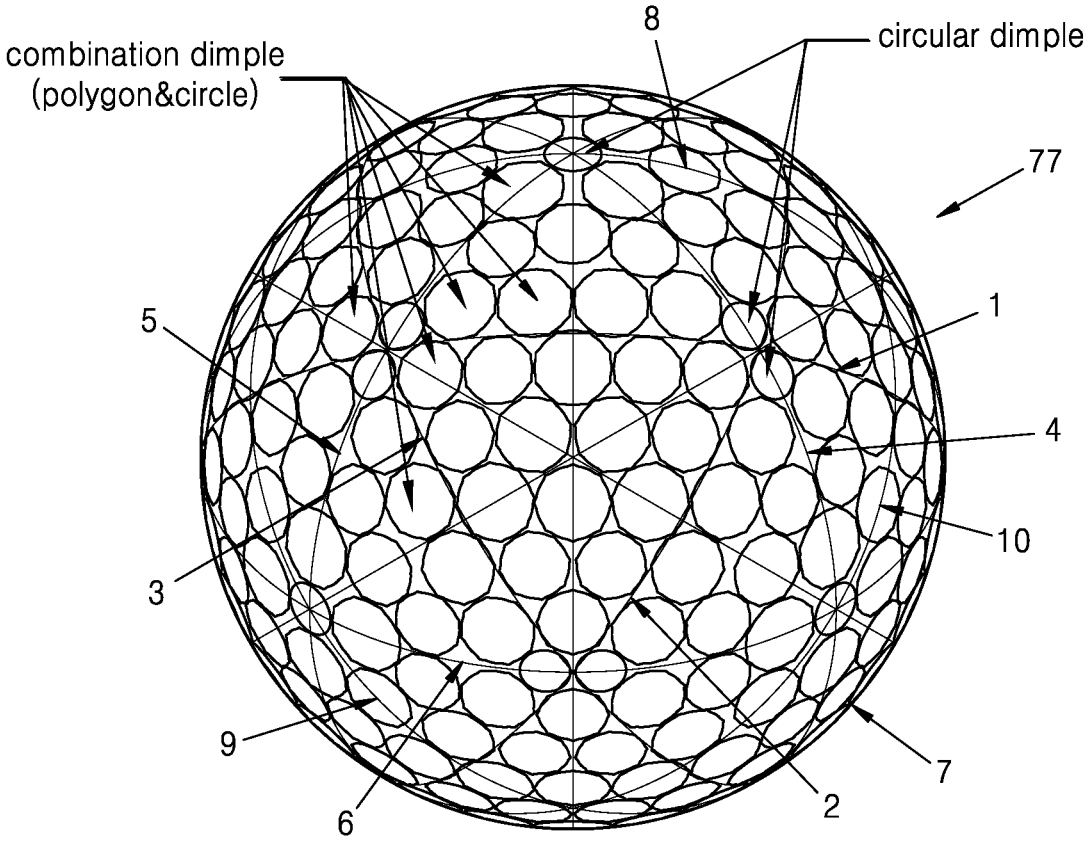
FIG. 4 shows a golf ball, in which a surface of a sphere is split into great circles and combination dimples made according to the present disclosure (combination of octagons with circles) are on a virtual spherical octahedron, with some general circular dimples mixed therein.

FIG. 4 shows an embodiment in which the combination dimples having the above-described size and depth are arranged on the surface of the sphere, wherein great circles 8, 9, and 10 are division lines to form each side of one large spherical triangle that forms a spherical tetrahedron consisting of four spherical triangles, and great circles 4, 5, and 6, which are extended by connecting adjacent center points, are division lines for forming a spherical octahedron including other eight spherical triangles. A spherical cube-octahedron including six spherical squares and eight small spherical triangles are formed by great circles 1, 2, 3 and 7 which are extended by connecting adjacent center points of the lines constructing sides of the spherical triangles that forms the spherical octahedron, wherein the great circle 7 is used as the equator and also as a mold parting line at which a northern hemisphere and a southern hemisphere of the golf ball meet each other. Among them, the combination dimples according to the present invention were arranged on a spherical polygon formed by the divisional composition of the great circles whose center of the spherical triangle in the center becomes a pole. And the combination dimples co used herein are combination dimples co formed by octagons and circles that are concentric, according to the present disclosure.

In an embodiment shown in FIG. 4, the combination dimples co are arranged to regularly include some circular dimples, which will be described with reference to the spherical octahedron made by the great circles 4, 5, and 6.

In the embodiment shown in FIG. 4, eight virtual spherical triangles are formed by the great circles indicated by great circles 4, 5, 6 in the drawing, arrangements of the dimples in the spherical triangles are identical, and by doing so, the dimple arrangement is performed in a symmetrical manner with respect to each of the great circles 4, 5, and 6.

In a golf ball 77, general circular dimples are arranged near each vertex and at a center of the spherical square in the spherical cube-octahedron. The arrangement of general circular dimples contributes to provide stability against wind during flight.

When the combination dimples of the present disclosure are arranged on the surface of the sphere, some of the general circular dimples may be used together as needed, but in cases, general polygon dimples may also be used. This may be a method of increasing a dimple area ratio or a method for an aesthetic effect.

Figure 5:
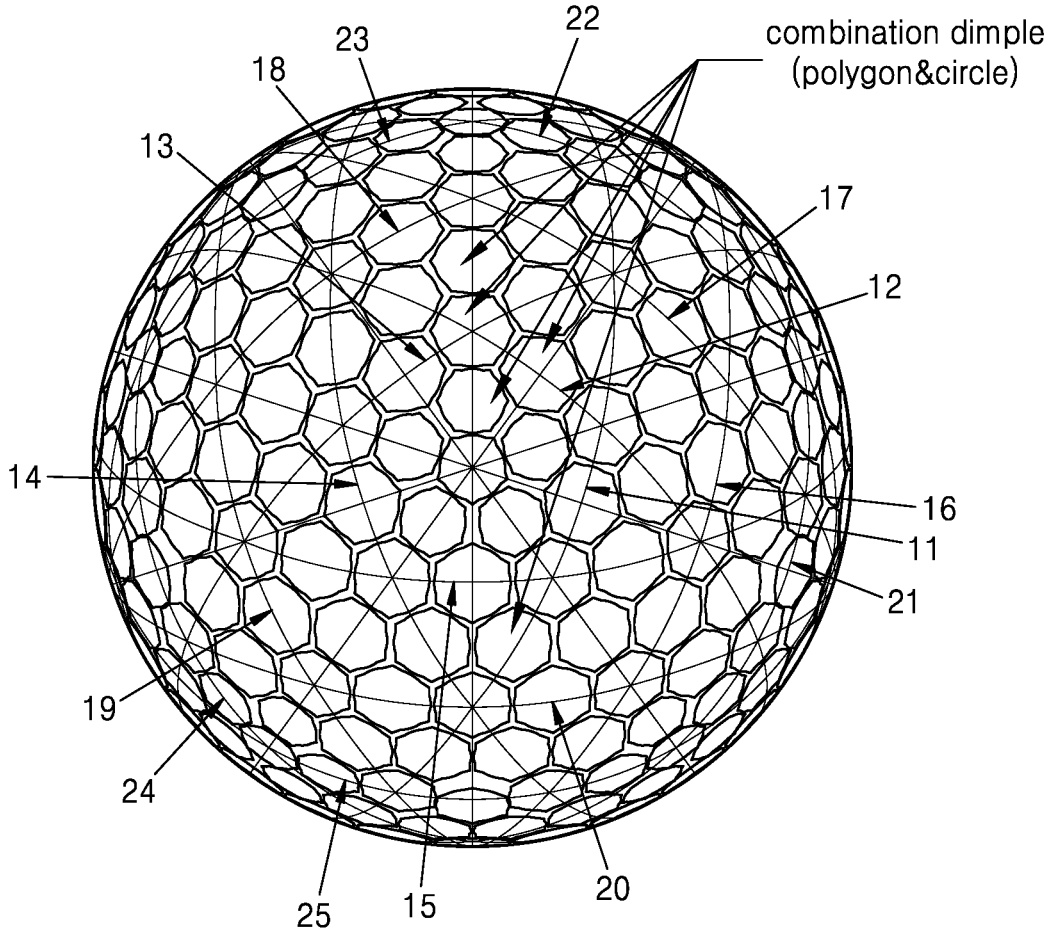
FIG. 5 shows a golf ball arranged with combination dimples (combination of hexagons and circles) made according to the present disclosure on a virtual spherical polyhedron that is made by dividing a surface of a sphere with small circles.

FIG. 5 shows another embodiment of arranging combination dimples co of size and depth consistent with the present disclosure on the surface of a sphere.

Unlike in FIG. 4, in the embodiment of FIG. 5, the surface of the sphere is divided by the line segment 11~25 of the small circles, and the combination dimples co according to the present disclosure are arranged with good left-right symmetry. Most of the combination dimples co by hexagons and circles are mainly arranged, and the pole region is a combination dimple of pentagon and circle was placed. In the arrangement of the combination dimples co some of the dimples may be in contact with one another.

Figure 6:
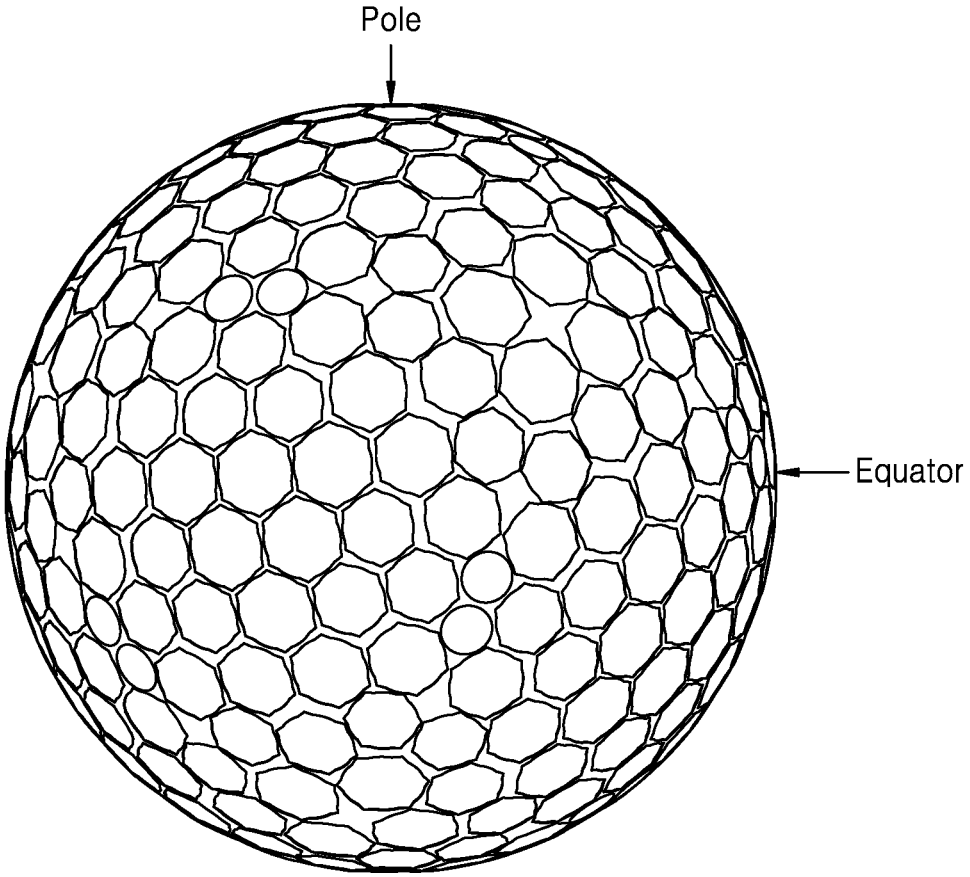
FIG. 6 shows an image of equator-centered modeling of a golf ball arranged with combination dimples co according to the present disclosure and some circular dimples.

FIG. 6 shows another embodiment in which the combination dimples according to the present disclosure are arranged on the surface of the sphere and modeled into a golf ball, as viewed from the equator.

Figure 7:
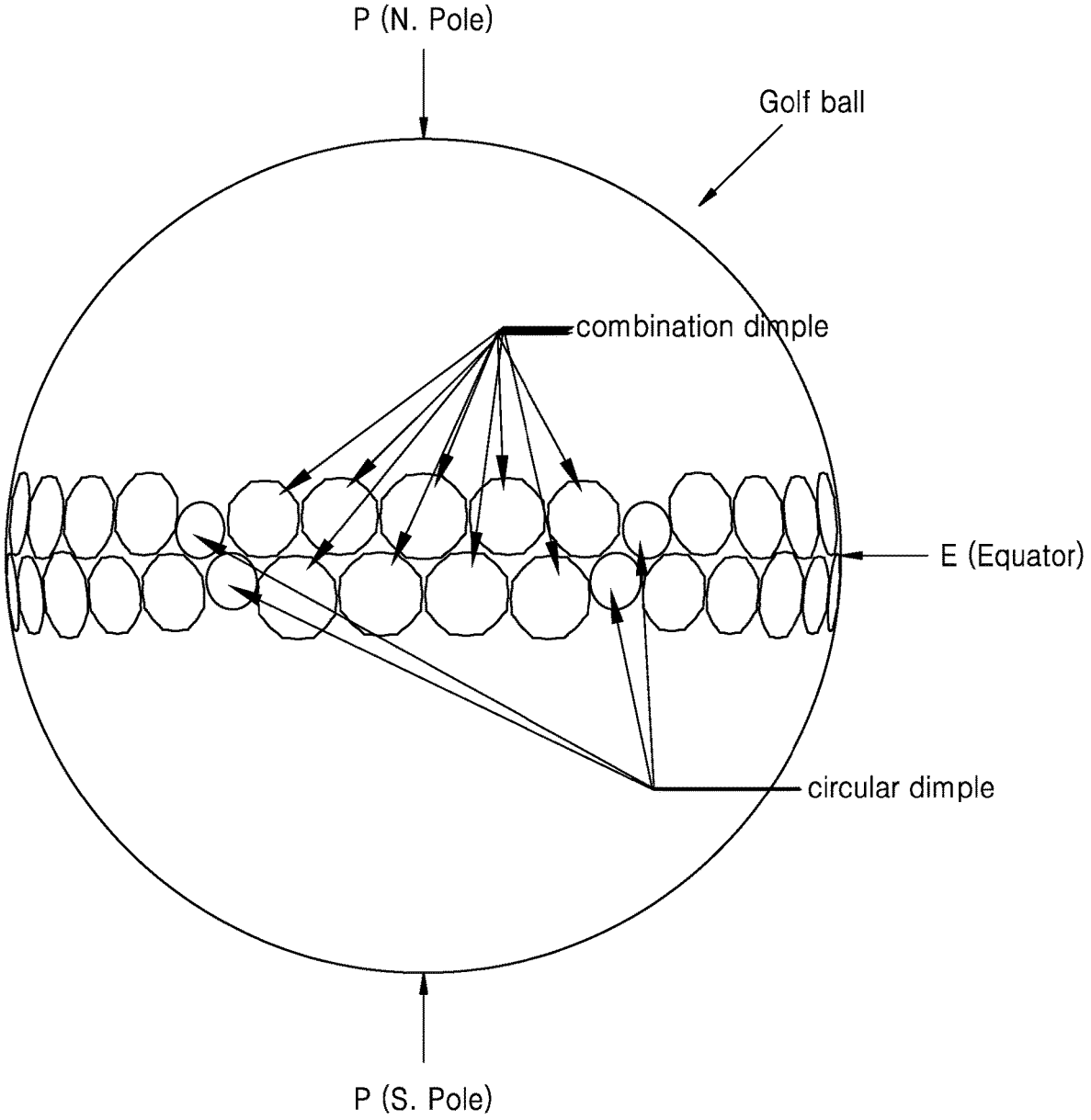
FIG. 7 is a diagram of an equator (a mold parting line) portion of the golf ball in FIG. 4 made according to the present disclosure, and shows an arrangement of combination dimples co and small circular dimples.

FIG. 7 shows a dimple arrangement at the equator that is the mold parting line when arranging the combination dimples like in FIG. 4 on the surface of the sphere.

In FIG. 7, arrangement with the general circular dimples is shown as an embodiment, but some dimples may intersect the equator line.

As described above, the golf ball according to the present disclosure, in which the combination dimples are arranged on the surface of the sphere, reduces the pressure applied to the entire dimple by making a rapid turbulent transition due to the small bluff body, making it a golf ball with better directionality and superior distance than general polygonal dimples or circular dimples. The golf ball according to the present disclosure, which is arranged on the surface with the combination dimples in which a depth is given to the face having the combined shape of the circle and polygon that are concentric, may reduce the drag by causing a rapid turbulent transition by the vertex portion of the polygon that protrudes with reference to a plane shape of the dimple, and at the same time, may maintain the same directionality as that of a general golf ball including circular dimples, and the flying distance may not decrease even in the low-speed region.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A golf ball in which dimples are formed in a surface of a sphere, wherein the dimples are combination dimples having planar shapes in which a circle and polygon having a same center are combined with each other, wherein the plane shape of the dimples is a shape in which a plurality of circular arcs are arranged at the same angle with respect to the center, and one polygonal vertex of the polygon is arranged between the plurality of circular arcs, wherein a diameter of the circle is from 82% to 98% of a diameter of a circumscribed circle of the polygon having a same center as that of the polygon, and in the polygon, a length from a vertex of the polygon to a point at which a line toward a center of the polygon and an arc of the circle meet each other is from 2% to 18% of a radius of the circumscribed circle of the polygon.

2. The golf ball of claim 1, wherein a depth of each combination dimple is from 0.1 mm to 0.25 mm.

3. The golf ball of claim 1, wherein the polygon of each combination dimple comprises at least two polygons from among a triangle, a square, a pentagon, a hexagon, and an octagon.

4. The golf ball of claim 1, wherein at least one of the dimples is not a combination dimple but a circular dimple.

5. The golf ball of claim 1, wherein at least one of the dimples is not a combination dimple but a polygonal dimple.

6. The golf ball of claim 1, wherein 50% or more of the surface of the sphere comprise the combination dimples.

7. The golf ball of claim 1, further comprising a plurality of circular dimples, wherein each of the plurality of circular dimples is interposed between at least two of the combination dimples.

8. The golf ball of claim 1, further comprising a plurality of circular dimples, wherein adjacent dimples on each side of at least one of the plurality of circular dimples is comprise the combination dimples.

9. The golf ball of claim 1, further comprising a plurality of circular dimples, wherein at least two circular dimples are adjacent one another and are surrounded by the combination dimples.

10. The golf ball of claim 1, further comprising a plurality of circular dimples, wherein the plurality of circular dimples and the combination dimples are arranged symmetrically about at least two axes of the golf ball.

11. The golf ball of claim 1, wherein:

the polygon comprises a square;

the diameter of the circle is from 82% to 88% of a diameter of the circumscribed circle of the polygon having the same center as that of the polygon; and in the polygon, a length from a vertex of the polygon to a point at which a line toward a center of the polygon and an arc of the circle meet each other is from 12% to 18% of a radius of the circumscribed circle of the polygon.

12. The golf ball of claim 1, wherein:

the polygon comprises a pentagon;

the diameter of the circle is from 85% to 91% of a diameter of the circumscribed circle of the polygon having the same center as that of the polygon; and in the polygon, a length from a vertex of the polygon to a point at which a line toward a center of the polygon and an arc of the circle meet each other is from 9% to 15% of a radius of the circumscribed circle of the polygon.

13. The golf ball of claim 1, wherein:

the polygon comprises a hexagon;

the diameter of the circle is from 88% to 94% of a diameter of the circumscribed circle of the polygon having the same center as that of the polygon; and in the polygon, a length from a vertex of the polygon to a point at which a line toward a center of the polygon and an arc of the circle meet each other is from 6% to 12% of a radius of the circumscribed circle of the polygon.

14. The golf ball of claim 1, wherein:

the polygon comprises an octagon;

the diameter of the circle is from 92% to 98% of a diameter of the circumscribed circle of the polygon having the same center as that of the polygon, and in the polygon, a length from a vertex of the polygon to a point at which a line toward a center of the polygon and an arc of the circle meet each other is from 2% to 8% of a radius of the circumscribed circle of the polygon.

15. The golf ball of claim 1, further comprising a plurality of circular dimples, wherein the plurality of circular dimples are spaced equidistantly about the surface of the sphere.

* * * * *